US008784285B1

(12) United States Patent
Lopez et al.

(10) Patent No.: US 8,784,285 B1
(45) Date of Patent: Jul. 22, 2014

(54) WEARABLE HARNESS SYSTEM FOR EXERCISE

(76) Inventors: Jose A. Lopez, Miami, FL (US); Liliana Leal Rivera, Miami, FL (US)

( * ) Notice: Subject to any disclaimer, the term of this patent is extended or adjusted under 35 U.S.C. 154(b) by 192 days.

(21) Appl. No.: 13/444,548

(22) Filed: Apr. 11, 2012

(51) Int. Cl.
*A63B 21/04* (2006.01)
*A63B 21/02* (2006.01)

(52) U.S. Cl.
USPC ..... 482/129; 482/121

(58) Field of Classification Search
CPC ..... A63B 1/0552; A63B 21/04; A63B 21/00; A63B 22/00007; A63B 22/12
USPC ..... 482/129, 92, 121, 130
See application file for complete search history.

(56) References Cited

U.S. PATENT DOCUMENTS 2,097,376 A * 10/1937 Marshman ..... 482/124
5,782,727 A * 7/1998 Pierce ..... 482/129
5,813,955 A * 9/1998 Gutkowski et al. ..... 482/124
7,147,590 B2 * 12/2006 Toven ..... 482/51
7,175,574 B2 * 2/2007 Carmel et al. ..... 482/124
7,484,961 B2 * 2/2009 Blaski et al. ..... 434/247
2009/0011909 A1 * 1/2009 Glisan ..... 482/129
2009/0305827 A1 * 12/2009 Webb et al. ..... 473/458

* cited by examiner

*Primary Examiner* — Loan H Thanh
*Assistant Examiner* — Megan Anderson
(74) *Attorney, Agent, or Firm* — Albert Bordas, P.A.

(57) ABSTRACT

A wearable harness system for exercise including an elastic waistband, a harness assembly, swivel strap assemblies, fixed strap assemblies and elastic bands. At least one elastic band is engaged to the loops of gloves and/or footwear. The elastic waistband adjusts around a user's body. The fixed strap and the swivel strap assemblies mount upon the lower and upper corners, respectively, of the harness assembly. Each swivel strap assembly comprises a base plate and an exterior plate with first and second edges disposed at predetermined angles. Between the base plate and the exterior plate is a strap assembly with a loop. A pin passes through the central holes of the base plate, the exterior plate and the strap assembly. Threads secure the base plate and the exterior plate to the harness assembly and the elastic band. The strap assemblies may rotate from a vertical to a horizontal position.

15 Claims, 5 Drawing Sheets

WEARABLE HARNESS SYSTEM FOR EXERCISE

BACKGROUND OF THE INVENTION

1. Field of the Invention

The present invention relates to exercise equipment, and more particularly, to wearable harness systems for exercise.

2. Description of the Related Art

Several exercise apparatuses and equipment have been developed in the past that provide for a number of more or less complicated features that fail to solve the problem in an efficient and economical way. None of those apparatuses and equipment suggests the novel features of the present invention.

SUMMARY OF THE INVENTION

The instant invention is a wearable harness system for exercise, comprising an elastic waistband, a harness assembly, a swivel strap assembly, a fixed strap assembly, and at least one elastic band.

The elastic waistband comprises a band having first and second ends, a top edge, a bottom edge, and fastening means to adjust the band around a user's body. The harness assembly comprises a cover having first and second lateral edges, a top edge and a bottom edge. The swivel strap assembly comprises a base plate and an exterior plate. The base plate and the exterior plate have perimeter holes. Between the base plate and the exterior plate is a strap assembly. The strap assembly comprises a strap having first and second ends and a loop. The exterior plate comprises first and second edges at predetermined angles from each other, and the strap comprises a first hole. The base plate comprises a second hole. The first and second holes align to receive a pin to secure the strap in between the base plate and the exterior plate. The fixed strap assembly comprises a loop. The at least one elastic band comprises first and second connectors. The first connector extends from the strap assembly and the second connector extends to a glove. Additionally, the first connector may extend from the fixed strap assembly and the second connector to footwear.

It is therefore one of the main objects of the present invention to provide a wearable harness system for exercise that may be worn to exercise and/or while performing other tasks such as working, performing housekeeping, gardening, etc.

It is another object of this invention to provide a wearable harness system for exercise to tone muscles of the user wearing it.

It is another object of this invention to provide a wearable harness system for exercise to the abdomen of the user wearing it.

It is another object of this invention to provide a wearable harness system for exercise that can be readily assembled and disassembled without the need of any special tools.

It is another object of this invention to provide a wearable harness system for exercise that is volumetrically efficient for carrying, transporting, and storage.

It is another object of this invention to provide a wearable harness system for exercise, which is of a durable and reliable construction.

It is yet another object of this invention to provide such a system that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
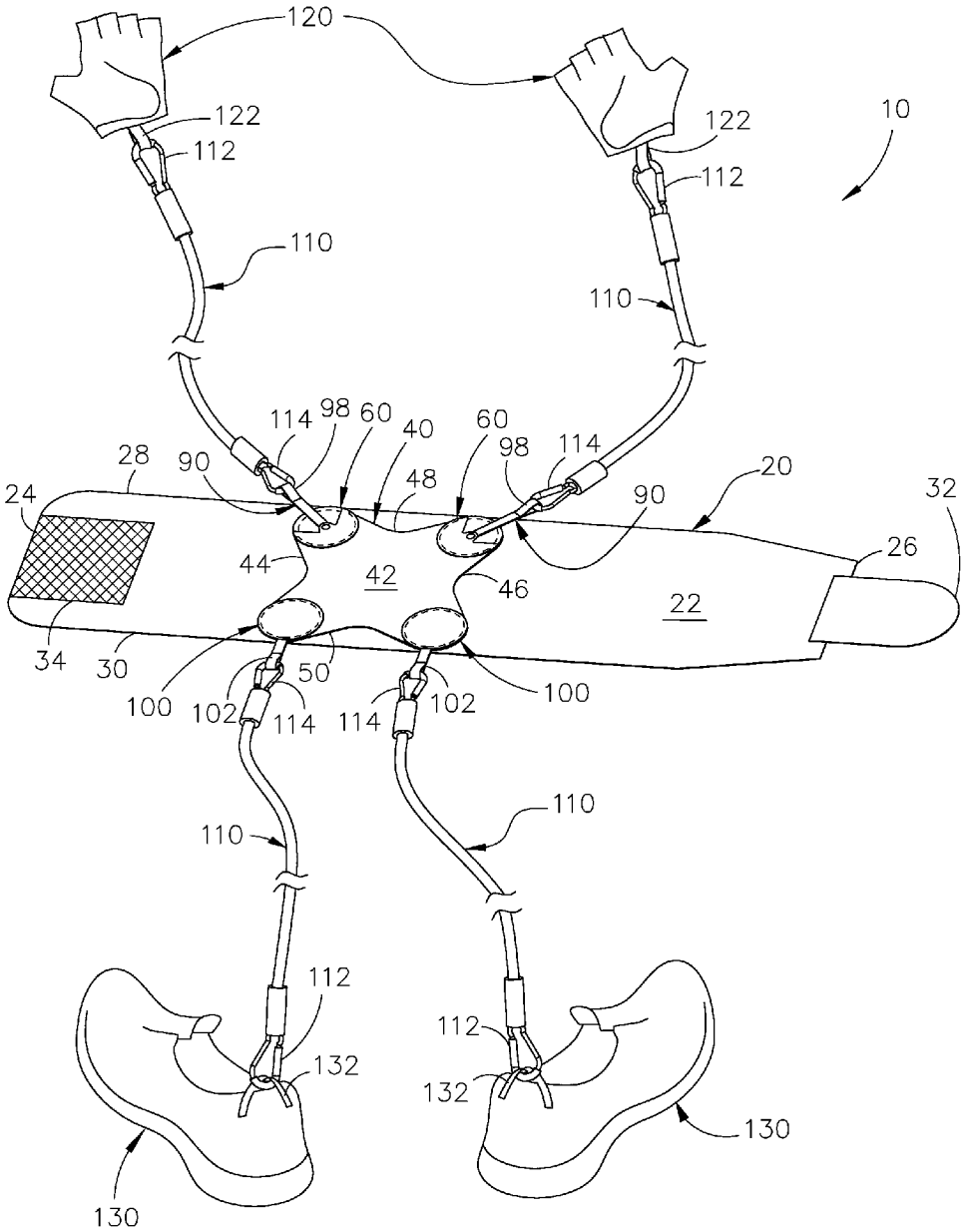
FIG. 1 is an isometric view of the present invention secured to gloves and footwear.

Referring now to the drawings, the present invention is generally referred to with numeral 10. It can be observed that it basically includes elastic waistband 20, harness assembly 40, swivel strap assembly 60, fixed strap assembly 100 and elastic bands 110.

As seen in FIG. 1, wearable harness system for exercise 10 is intended to be used with elastic bands 110. Elastic bands 110 have connectors 112 and 114 at opposite ends. At least one elastic band 110 is engaged to loops 122 of gloves 120 and/or loops 132 of footwear 130. Specifically, connector 112 engages loop 122 and connector 114 of the same elastic band 110 engages loop 98 of strap assembly 90, and/or connector 112 engages loop 132 and connector 114 of the same elastic band 110 engages loop 102 of fixed strap assembly 100.

Figure 2:
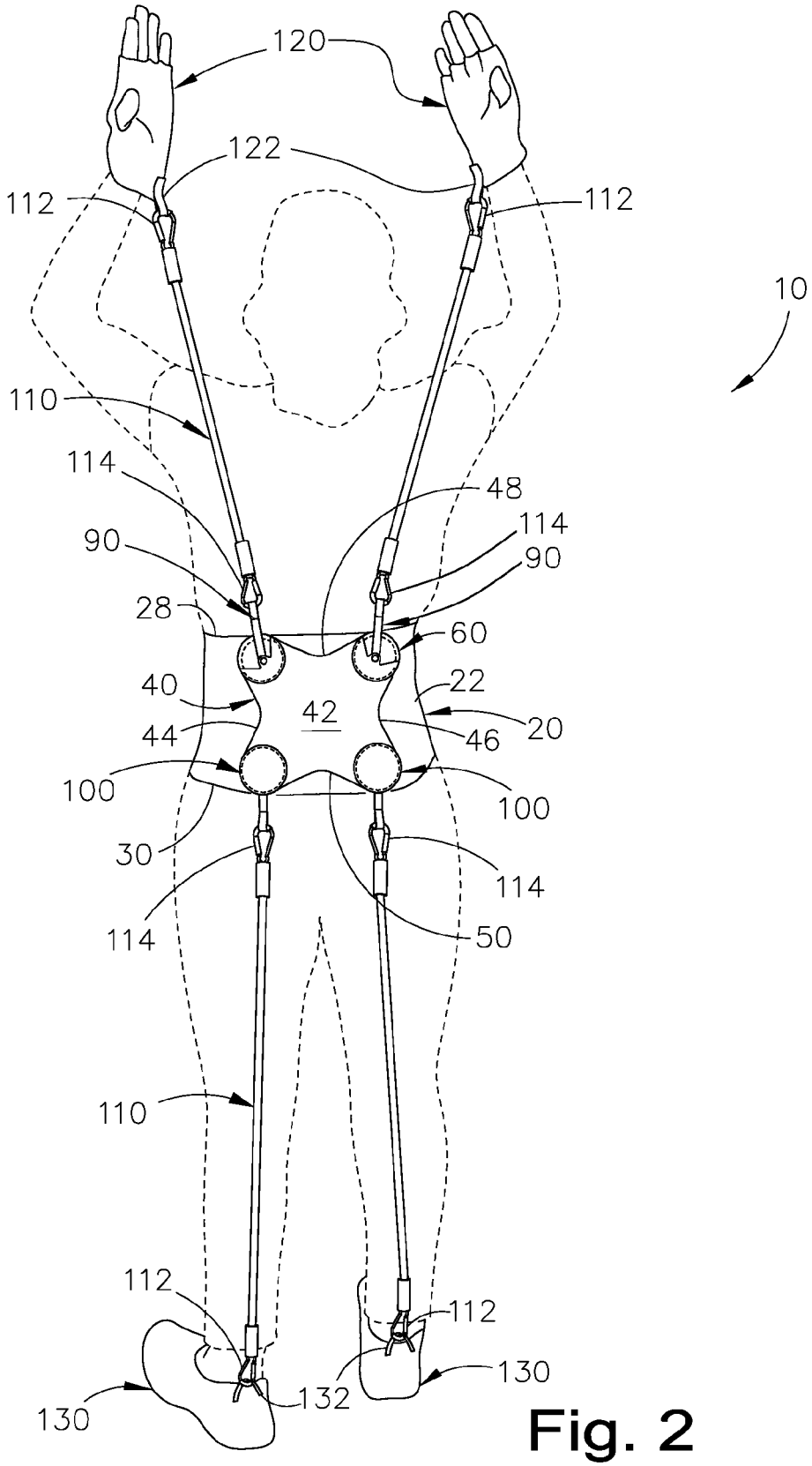
FIG. 2 is an isometric view of the present invention used in a first orientation for exercise of a user's upper and lower torso.
Figure 3:
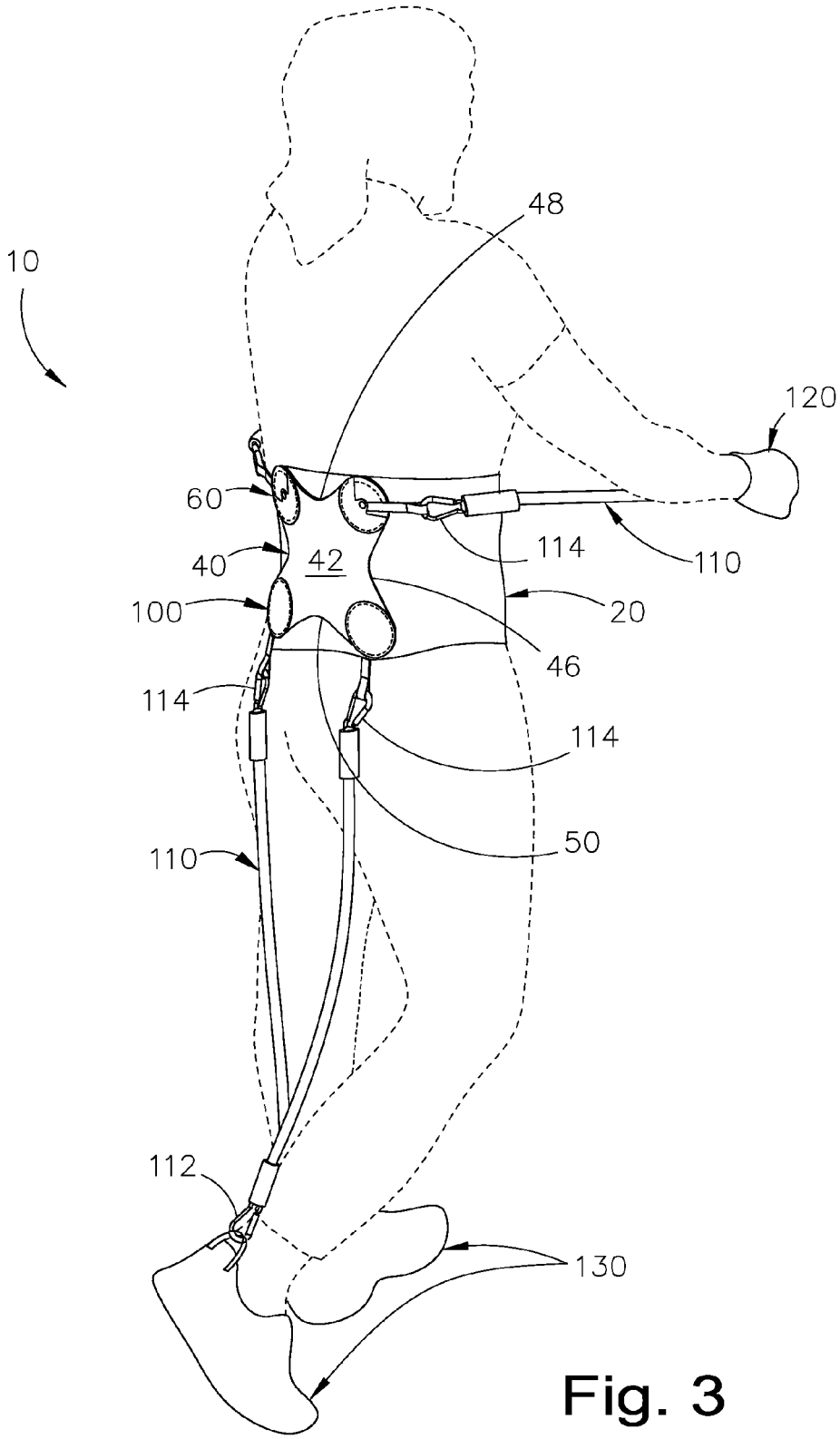
FIG. 3 is an isometric view of the present invention used in a second orientation for exercise of the user's upper and lower torso.

Elastic waistband 20 comprises band 22 having ends 24 and end 26, top edge 28 and bottom edge 30. Elastic waistband 20 further comprises fastening means to adjust band 22 around a user's body. Extending from end 26 is tongue 32. The interior side of tongue 32 has a loop section (not shown) that cooperatively engages onto hook section 34, adjacent to end 24, to configure a hook-and-loop fastening means. Alternate fastening means may be used to adjust band 22 around a user's body, as seen in FIGS. 2 and 3. In a preferred embodiment, elastic waistband 20 is made of a material that promotes water/weight loss.

Harness assembly 40 comprises cover 42 having lateral edges 44 and 46, top edge 48, and bottom edge 50.

Fixed strap assemblies 100 comprise loop 102. In a preferred embodiment, fixed strap assemblies 100 are fixed to lower corners of harness assembly 40 defined by lateral edges 44 and 46 with bottom edge 50.

In the preferred embodiment, swivel strap assemblies 60 are mounted at upper corners of harness assembly 40, defined by lateral edges 44 and 46 with top edge 48. Swivel strap assemblies 60 permit the user to move her/his arms from a vertical to a horizontal position and in-between, as best shown in FIGS. 2 and 3.

Figure 4:
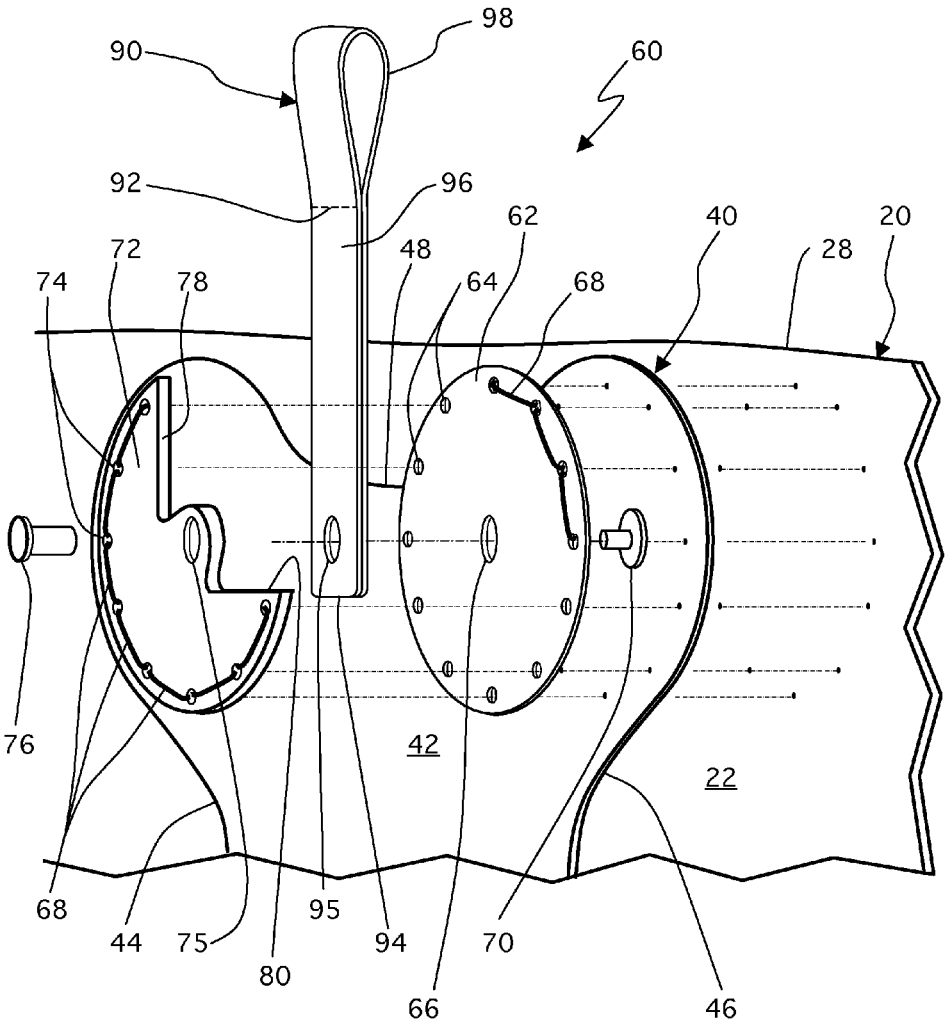
FIG. 4 is an exploded view of a swivel strap assembly, showing internal parts.

As seen in FIG. 4, each swivel strap assembly 60 comprises base plate 62 and exterior plate 72. Base plate 62 has perimeter holes 64 and central hole 66. Exterior plate 72 has perimeter holes 74 and central hole 75. Exterior plate 72 also comprises first and second edges 78 and 80 disposed at predetermined angles from each other without reaching an area surrounding central hole 75.

In the preferred embodiment, first edge 78 is at a substantially vertical disposition and second edge 80 is at a substantially horizontal disposition, defining upper exterior quadrants of harness assembly 40 when exterior plate 72 is mounted thereto. Between base plate 62 and exterior plate 72 is strap assembly 90. Strap assembly 90 comprises strap 96 with ends 92 and 94. Loop 98 extends from end 92. At a predetermined distance from end 94, strap assembly 90 has through hole 95. In the preferred embodiment, central hole 66, through hole 95 and central hole 75 align to receive pin 76 therethrough, thus securing strap assembly 90 in between base plate 62 and exterior plate 72. Rivet 70 can be used to secure pin 76.

Figure 5:
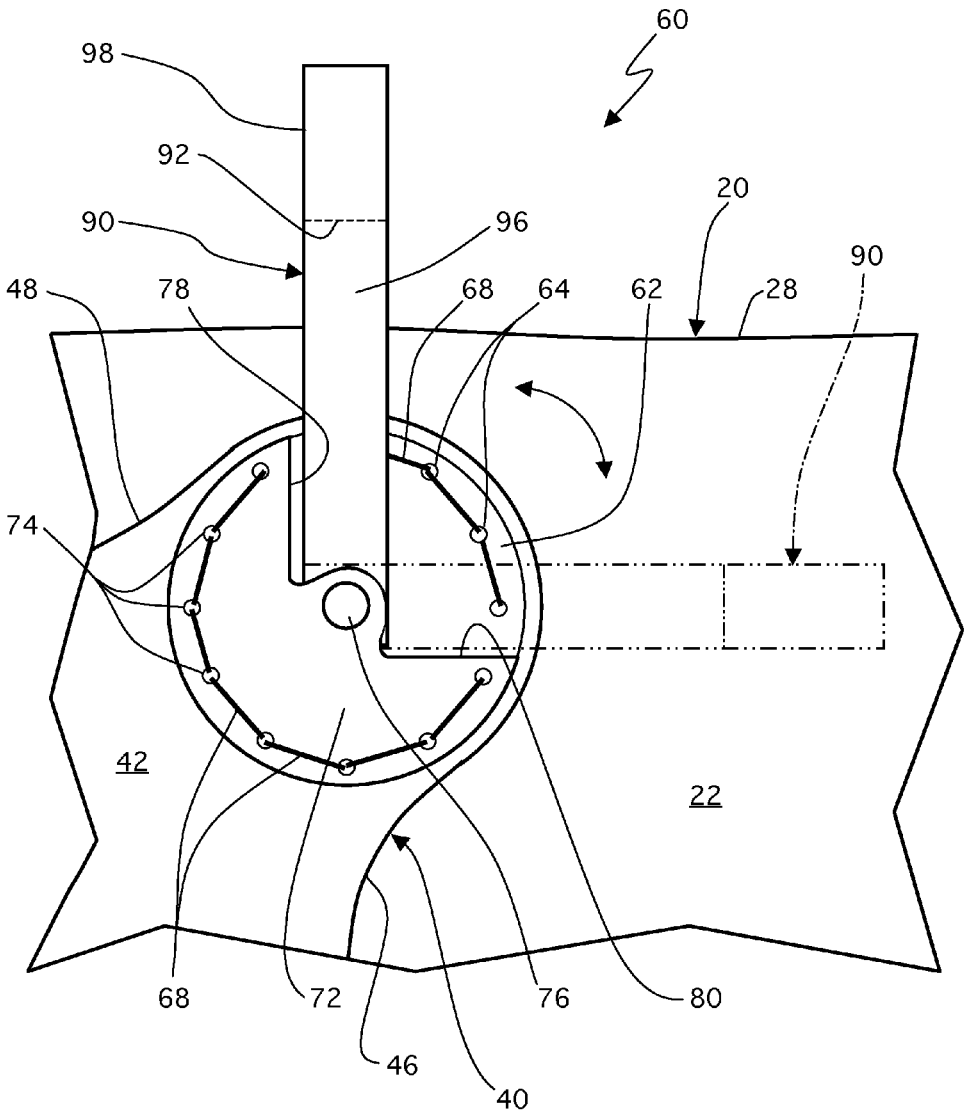
FIG. 5 is a front elevational view of the swivel strap assembly.

A first thread 68 is threaded through perimeter holes 74 and the cooperatively aligned perimeter holes 64 to secure base plate 62 and exterior plate 72 to cover 42 and band 22. Remaining perimeter holes 64 defined on base plate 62 between first and second edges 78 and 80, are independently secured to cover 42 and band 22 with another thread 68. Strap assembly 90 may pivot upon pin 76 from a substantially vertical position to a substantially horizontal position, as best seen in FIG. 5, according to the user's preferences. First and second edges 78 and 80 and the first thread 68 limit movement of strap assembly 90 as best seen in FIG. 5.

Present invention 10 is used for exercising, permitting movement of various body parts with resistance from elastic bands 110 to improve muscular tone and strength. Multiple elastic bands 110 or various tensions may also be used with present invention 10.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A wearable harness system for exercise, comprising:

A) an elastic waistband;

B) a harness assembly;

C) a swivel strap assembly, said swivel strap assembly comprises a base plate and an exterior plate, said base plate and said exterior plate having perimeter holes;

D) a fixed strap assembly; and

E) at least one elastic band.

2. The wearable harness system for exercise set forth in claim 1, wherein said base plate and said exterior plate is a strap assembly.

3. The wearable harness system for exercise set forth in claim 2, wherein said strap assembly comprises a strap having first and second ends and a loop.

4. The wearable harness system for exercise set forth in claim 3, wherein said strap comprises a first hole.

5. The wearable harness system for exercise set forth in claim 4, wherein said base plate comprises a second hole.

6. The wearable harness system for exercise set forth in claim 4, wherein said first and second holes align to receive a pin to secure said strap in between said base plate and said exterior plate.

7. The wearable harness system for exercise set forth in claim 1, wherein said at least one elastic band comprises first and second connectors.

8. The wearable harness system for exercise set forth in claim 7, wherein said first connector extends from said strap assembly.

9. The wearable harness system for exercise set forth in claim 8, wherein said second connector extends to a glove.

10. The wearable harness system for exercise set forth in claim 7, wherein said first connector extends from said fixed strap assembly.

11. The wearable harness system for exercise set forth in claim 10, wherein said second connector extends to footwear.

12. The wearable harness system for exercise set forth in claim 1, wherein said elastic waistband comprises a band having first and second ends, a top edge, a bottom edge, and fastening means to adjust said band around a user's body.

13. The wearable harness system for exercise set forth in claim 1, wherein said harness assembly comprises a cover having first and second lateral edges, a top edge and a bottom edge.

14. The wearable harness system for exercise set forth in claim 1, wherein said exterior plate comprises first and second edges at predetermined angles from each other.

15. The wearable harness system for exercise set forth in claim 1, wherein said fixed strap assembly comprises a loop.

* * * * *